US009770813B2

(12) United States Patent
Wang

(10) Patent No.: US 9,770,813 B2
(45) Date of Patent: Sep. 26, 2017

(54) RATCHET TOOL

(71) Applicants: HANGZHOU GREAT STAR TOOLS CO., LTD, Hangzhou, Zhejiang Province (CN); HANGZHOU GREAT STAR INDUSTRIAL CO., LTD, Hangzhou, Zhejiang Province (CN)

(72) Inventor: Weiyi Wang, Hangzhou (CN)

(73) Assignees: Hangzhou Great Star Tools, Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 0 days.

(21) Appl. No.: 14/369,795

(22) PCT Filed: Jun. 13, 2014

(86) PCT No.: PCT/CN2014/079842
§ 371 (c)(1),
(2) Date: Jan. 7, 2016

(87) PCT Pub. No.: WO2015/188373
PCT Pub. Date: Dec. 17, 2015

(65) Prior Publication Data

US 2017/0087696 A1 Mar. 30, 2017

(51) Int. Cl.
*B25B 15/04* (2006.01)
*B25B 23/18* (2006.01)

(52) U.S. Cl.
CPC ..... *B25B 15/04* (2013.01); *B25B 23/18* (2013.01)

(58) Field of Classification Search
CPC ..... B25B 15/04; B25B 23/18
See application file for complete search history.

(56) References Cited

U.S. PATENT DOCUMENTS 2,720,296 A * 10/1955 Briglia ..... B25B 13/463 192/43.1
5,613,585 A * 3/1997 Tiede ..... B25B 13/463 192/43.1

(Continued)

FOREIGN PATENT DOCUMENTS

CN 101104260 A 1/2008
CN 101890688 A 11/2010

(Continued)

*Primary Examiner* — David B Thomas
(74) *Attorney, Agent, or Firm* — Ohlandt, Greeley, Ruggiero & Perle, L.L.P.

(57) ABSTRACT

A ratchet tool includes a shaft member, a handle and a ratchet mechanism, in which the handle is connected to the ratchet mechanism, and the shaft member extends into the interior of the ratchet mechanism along the central axle of the ratchet mechanism from the front end of the ratchet mechanism and is connected to the ratchet mechanism. The shaft member includes a shaft and an extension portion which passes through the rear end of the ratchet mechanism along the central axle of the ratchet mechanism from the front end of the ratchet mechanism and is connected to the ratchet mechanism, and the shaft is designed to be integrated with or separated from the extension portion. Such a design of the shaft member solves the wobble problem of the shaft. The ratchet tool of the present invention also includes a lighting device. The ratchet tool of the present invention requires small turning force when turning back and has strong capacity of torque transferring, and at the same time achieves lighting feature.

19 Claims, 10 Drawing Sheets

(56) References Cited

U.S. PATENT DOCUMENTS 6,047,801 A * 4/2000 Liao ..... B25B 15/04 192/43.2
6,082,226 A * 7/2000 Lin ..... B25B 13/465 192/43.1
6,244,139 B1 6/2001 Huang et al.
6,658,970 B2 * 12/2003 Shiao ..... B25B 15/04 192/43.1
6,854,363 B2 * 2/2005 Ping ..... B25B 15/04 192/43.2
6,925,912 B2 * 8/2005 Huang ..... B25B 13/463 192/43.2
6,935,211 B2 * 8/2005 Chen ..... B25B 15/04 81/438
7,028,587 B1 * 4/2006 Chiang ..... B25B 15/04 81/62
7,748,296 B2 * 7/2010 Hu ..... B25B 15/04 81/57.3
7,993,023 B2 * 8/2011 Wang ..... B25B 23/18 362/119
8,210,072 B2 * 7/2012 Suter ..... B25B 15/04 81/59.1
8,272,298 B2 * 9/2012 Chen ..... B25B 13/463 81/63.1
8,544,365 B2 * 10/2013 Wang ..... B25B 13/463 81/63.1
8,806,987 B2 * 8/2014 Chen ..... B25B 13/463 81/63.1
9,028,088 B2 * 5/2015 Vanko ..... B25F 5/021 362/119
9,162,348 B2 * 10/2015 Ho ..... B25B 15/04 81/58.4
9,242,355 B2 * 1/2016 Sergyeyenko ..... B25B 21/00
9,278,435 B2 * 3/2016 Tsai ..... B25B 13/463
9,427,861 B2 * 8/2016 Reynolds ..... B25G 1/085
2004/0154439 A1 * 8/2004 Tuan-Mu ..... B25B 13/463 81/58.4
2008/0266845 A1 * 10/2008 Wu ..... B25B 15/02 362/157
2008/0278930 A1 * 11/2008 Wu ..... B25B 15/02 362/120
2008/0278931 A1 * 11/2008 Wu ..... B25B 15/02 362/120
2009/0044668 A1 * 2/2009 Lin ..... B25B 15/00 81/478
2010/0018366 A1 1/2010 Hu
2013/0319185 A1 * 12/2013 Lai ..... B25B 13/463 81/63.1
2014/0310882 A1 * 10/2014 Reynolds ..... B25G 1/085 7/158
2015/0049467 A1 * 2/2015 Thompson ..... B25B 23/18 362/120
2015/0336245 A1 * 11/2015 Wang ..... B25B 17/00 81/57.31

FOREIGN PATENT DOCUMENTS

CN 201677279 U 12/2010
CN 201816012 U 5/2011
CN 103192337 A 7/2013

* cited by examiner

RATCHET TOOL

FIELD OF THE INVENTION

The present invention relates to a hand tool and, more particularly, to a ratchet tool.

DESCRIPTION OF THE PRIOR ART

Screwdrivers are tools used for screwing a screw to keep it in place, which includes a shaft and a handle. A prior art screwdriver commonly has its shaft secured to the handle. When in use, the hand holding the handle can only turn by a small angle. Therefore, the hand needs to stop several times during the process when an element is required to be rotated consecutively for multiple times, to allow the hand to turn reversely by an angle. One of the methods is to release the screwdriver by the hand holding it temporarily from the element to allow the hand to turn in reverse direction, which requires directing the screwdriver to the element again. Another method is to use the other hand to help and allow the hand holding the handle to release from the handle and turn in reverse direction. Obviously, both methods have inconveniences, which affect working efficiency, and the screw head is also prone to damage.

In order to overcome the above-mentioned defects, directional hand screwdrivers are produced as required. The 'directional' functionality of such hand screwdrivers is that when the handle is rotated in one direction the handle takes the working shaft to rotate together so as to apply torque to the element, and when the handle is rotated in the other direction the handle is rotated relative to the working shaft and the working shaft is positioned on the element, so that the handle is held by the hand and can be rotated back and forth consecutively without any stop, realizing the object of quick screwing or unscrewing the element, and further, such action is direction changeable.

Chinese Patent ZL 201010184827.4 has disclosed a ratchet screwdriver, which includes a handle and a shaft, in which the front end of the handle has a pawl seat which is disposed with two reversed and partially rotatable pawls and a toggle piece for controlling positional states of the two pawls. The toggle piece is provided with two toggle blocks which correspond to the above two pawls, respectively. The rear end of the shaft is provided with a pawl sleeve which is provided on the ratchet seat and engages with at least one of the two pawls, and a controlling member which is positionable on the handle is provided for changing the position of the toggle piece. It is proved by analyses and experiments that the following defects reside in the above ratchet screwdriver:

1. The axle hole in the pawl sleeve and the axle section on the pawl seat extending forward into the axle hole are adopted to cooperate with each other, resulting in a small cooperating area of the shaft and the pawl base, strong wobbling of the shaft relative to the pawl seat, and poor performance of screwing a screw.

2. The number of teeth engaged between the pawl and the pawl sleeve is small, and the capacity of transferring torque is weak.

3. The number of the teeth of the ratchet is small, and the turning force required during turning back is large, so that the 'directional' feature cannot perform well when a screwdriver with low pretension force is turned.

Therefore, a screwdriver which can solve the wobble problem of the shaft, and which is also efficient, is desired.

In addition, since the ratchet screwdrivers are widely used, and when used under low lighting or dark environments, additional lighting devices are usually resorted to, which brings inconvenience to the operation, so a ratchet screwdriver with a further lighting feature is desired.

SUMMARY OF THE INVENTION

One object of the present invention is to provide a ratchet tool with diminished shaft wobble, in which the shaft member extends into the interior of the ratchet mechanism, and which is designed in simple structure and is convenient to use.

Another object of the present invention is to solve the problem with ordinary screwdrivers that high turning force is required when it is turned back and capacity of transferring torque is low, by means of changing the number of teeth of the ratchet and pawls.

A further object of the present invention is to realize the lighting feature which an ordinary screwdriver does not have by means of introducing a lighting device.

In order to realize the above objects, the present invention provides a ratchet tool, comprising a shaft member, a handle and a ratchet mechanism, in which the handle is connected to the ratchet mechanism, and the shaft member extends into the interior of the ratchet mechanism along the central axle of the ratchet mechanism from the front end of the ratchet mechanism and is connected to the ratchet mechanism.

Preferably, the shaft member passes through the rear end of the ratchet mechanism along the central axle of the ratchet mechanism from the front end of the ratchet mechanism and is connected to the ratchet mechanism. More preferably, the shaft member is connected to the ratchet mechanism in a removable way. Further, the shaft member has a first end away from the handle and a second end adjacent the handle, the first end or the second end being able to extend into the interior of the ratchet mechanism along the central axle of the ratchet mechanism from the front end of the ratchet mechanism and connected to the ratchet mechanism.

Further, the shaft member includes a shaft and an extension portion which extends into the interior of the ratchet mechanism along the central axle of the ratchet mechanism from the front end of the ratchet mechanism and is connected to the ratchet mechanism.

Further, the shaft is designed to be integrated with or separated from the extension portion.

Further, the ratchet mechanism includes a pawl base symmetrically arranged with two partially rotatable pawls: a first pawl and a second pawl along both sides of the central axle on the pawl base, and a direction switching member for controlling the positional state of the two pawls, the direction switching member having thereon two stopping blocks: a first stopping block and a second stopping block at the outside of the two pawls respectively for pushing the first pawl and the second pawl respectively, a pawl sleeve arranged outside the first and second pawls and the first and second stopping blocks, the inner wall of the pawl sleeve having annularly distributed inner pawl teeth, the pawl sleeve being able to engage with the teeth on the first pawl and the second pawl.

Further, the number of the inner pawl teeth of the pawl sleeve is larger than 60, preferably 72. The number of the teeth of the first pawl is larger than 3, preferably 5. The number of the teeth of the second pawl is larger than 3, preferably 5.

Further, a positioning device connecting the direction switching member is also arranged outside the pawl sleeve, preferably an annular sleeve arranged around the outside of the pawl sleeve.

Further, the ratchet tool also includes a lighting device, the positioning device including a cavity where the light device is mounted. The lighting device includes an electric circuit board and a power mounted on the electric circuit board.

In which, the ratchet mechanism has two ends: an end adjacent the pawl sleeve and another end away from the pawl sleeve. The front end refers to the end thereof adjacent the pawl sleeve, and, correspondingly, the rear end thereof refers to the other end away from the pawl sleeve.

In which, 'extending into the interior of the ratchet mechanism' includes two cases which are passing through the rear end of the ratchet mechanism and not passing through the rear end of the ratchet mechanism.

A further description will be made as to the conception, detailed structure, and expected technical effects of the present invention with reference to the accompanying drawings to make the objects, features, and advantages of the present invention fully understandable.

DETAILED DESCRIPTION OF THE PREFERRED EMBODIMENTS

Embodiment 1

FIGS. 1-15 show the related structural schematic view of a preferred embodiment of the present invention.

Figure 1:
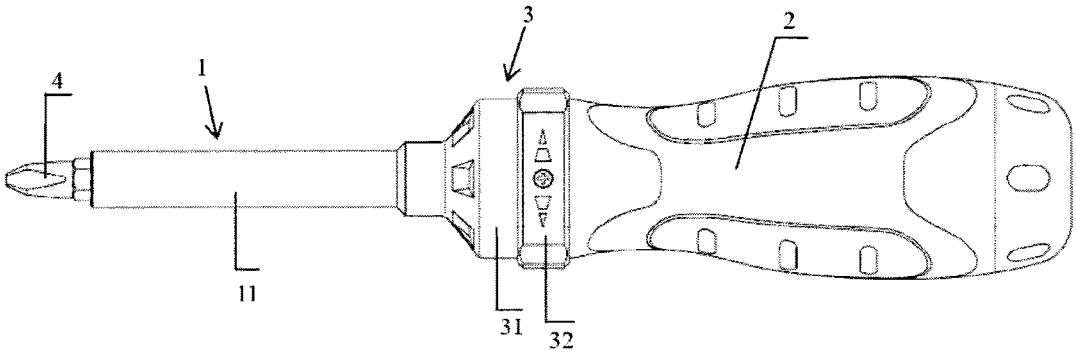
FIG. 1 is a main view of a preferred embodiment of the ratchet tool of the present invention.
Figure 2:
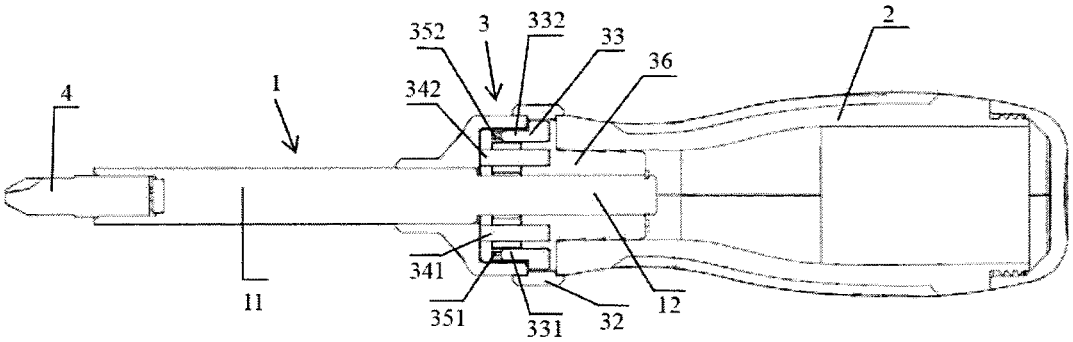
FIG. 2 is a longitudinal sectional view of the ratchet tool of FIG. 1, in which the ratchet member passes through the pawl base.
Figure 3:
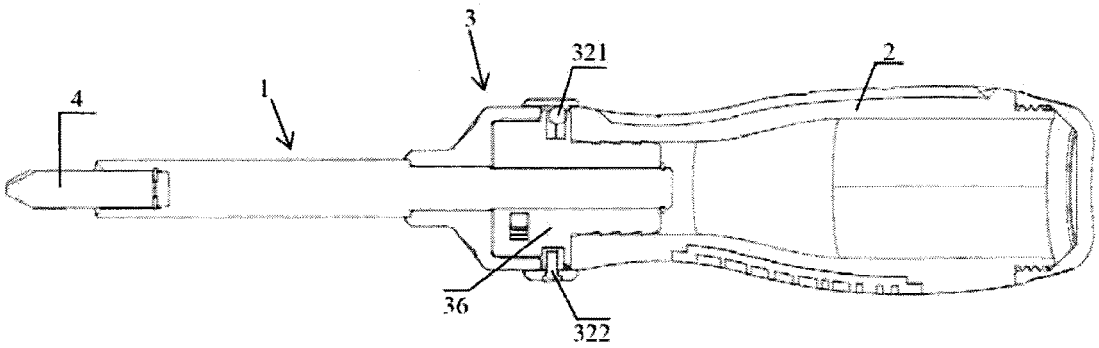
FIG. 3 is a transverse sectional view of the ratchet tool of FIG. 1, in which the ratchet member passes through the pawl base.

As shown in FIGS. 1-3, the ratchet tool of the present invention includes a shaft member 1, a handle 2 and a ratchet mechanism 3. The handle 2 is connected to the ratchet mechanism 3, and the shaft member 1 extends into the interior of the ratchet mechanism 3 along the central axle of the ratchet mechanism 3 from the front end of the ratchet mechanism 3 and is connected to the ratchet mechanism 3. In this embodiment, the shaft member 1 preferably passes through the rear end of the ratchet mechanism 3 along the central axle of the ratchet mechanism 3 from the front end of the ratchet mechanism 3 and is connected to the ratchet mechanism 3.

In which, the shaft member 1 further includes a shaft 11 and an extension portion 12. In this embodiment, the shaft 11 is designed to be integrated with the extension portion 12 which extends into the interior of the ratchet mechanism 3 and passes through the rear end of the ratchet mechanism 3 along the central axle of the ratchet mechanism 3 from the front end of the ratchet mechanism 3 and is connected to the ratchet mechanism 3. The structure of the shaft member 1 is more clearly illustrated in FIG. 6, where the rear end of the shaft 11 is provided with a key slot 14 which may be designed as a single piece or a couple located at both opposing side of the shaft 11 (shown in FIG. 7). The key slot 14 matches the pawl sleeve 31, used for firmly securing the shaft 11 and the pawl sleeve 31, to make the shaft 11 not wobble relative to the pawl sleeve 31 when torque is being transferred.

An operating portion 4 is provided on the end of the shaft member 1 away from the handle for outputting torque. The operating portion 4 may specifically be a screwdriver bit of various models, such as a slotted, torx or hex socket screwdriver bit, which is mounted on the end of the shaft member 1 away from the handle (shown in FIG. 1). The operating portion 4 may also be a sleeve of various models, and the sleeve may be designed to be integrated with the shaft member 1 (shown in FIG. 8), and may be connected to the shaft member 1 through a connecting member 41 (shown in FIG. 9) which can be used for mounting a sleeve of various models.

The diameter of the shaft 11 is greater than that of the extension portion 12. The rear end of the extension portion 12 is provided with an axle slot 15, and a fastening ring 13 (such as a retainer ring) is correspondingly designed for matching the axle slot 15. When the extension portion 12 passes through the bore of the pawl base 36, the fastening ring 13 matching the axle slot 15 is stuck into the axle slot. As the diameter of the shaft 11 is greater than that of the extension portion 12, and the axle slot 15 and the fastening ring 13 are cooperatively used in combination, the pawl base 36 is firmly secured to the shaft member without axial movement. In addition, such way of connection of the shaft member 1 and the ratchet mechanism 3 provides a long matching surface between the shaft member 1 and the bore of the pawl base 36, increasing the contact area between the shaft member 1 and the pawl base 36, so that the wobble problem of the shaft 11 relative to the pawl base 36 when using the ratchet tool is solved, and the screwing efficiency is good.

In this embodiment, the inputted torque from the handle 2 in any directions (clockwise direction or counterclockwise direction) is transferred to the shaft member 1, causing it to output the torque in a predetermined direction (either clockwise or counterclockwise).

Figure 4:
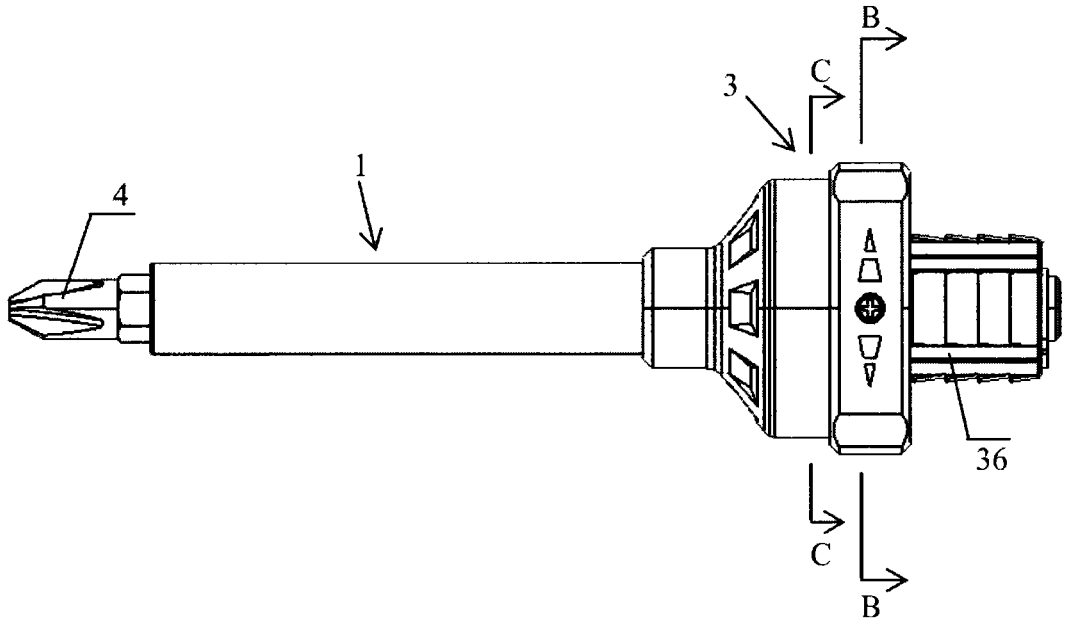
FIG. 4 is an overall schematic view of the direction switching mechanism, shaft member and ratchet mechanism of the ratchet tool in FIG. 1.
Figure 5:
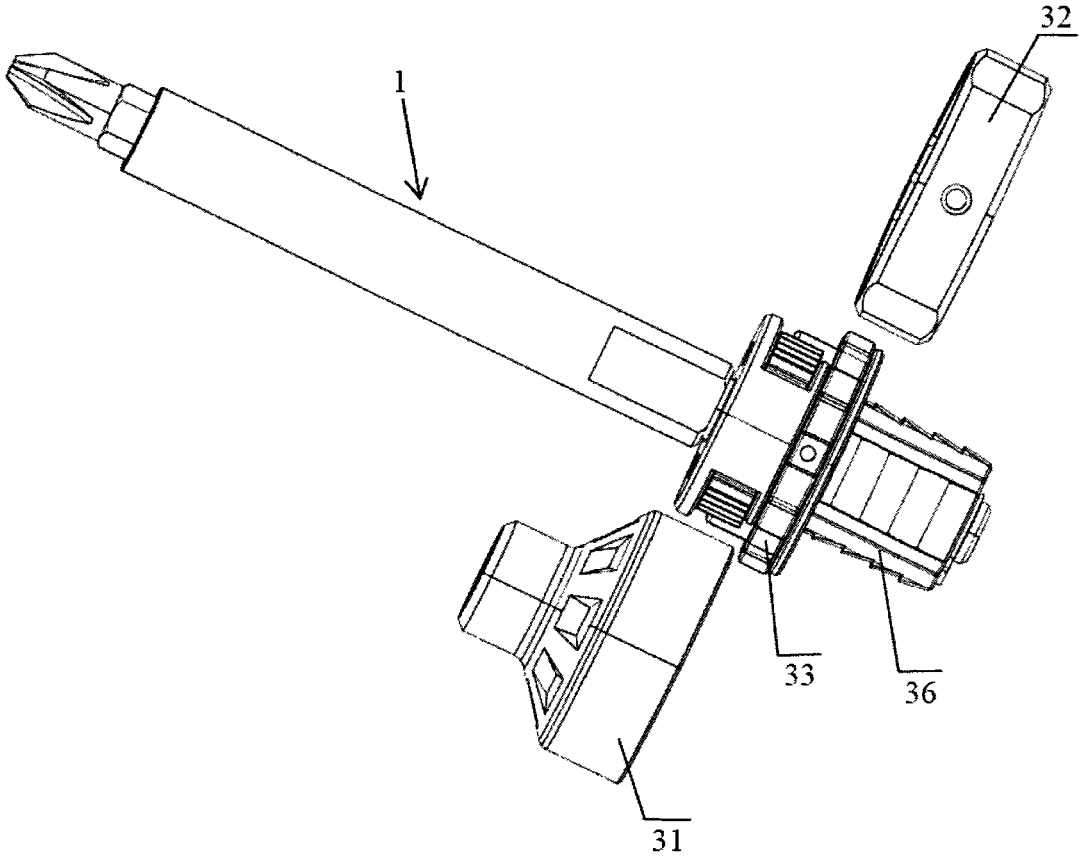
FIG. 5 is an exploded perspective view of FIG. 4 from an angle of view.
Figure 6:
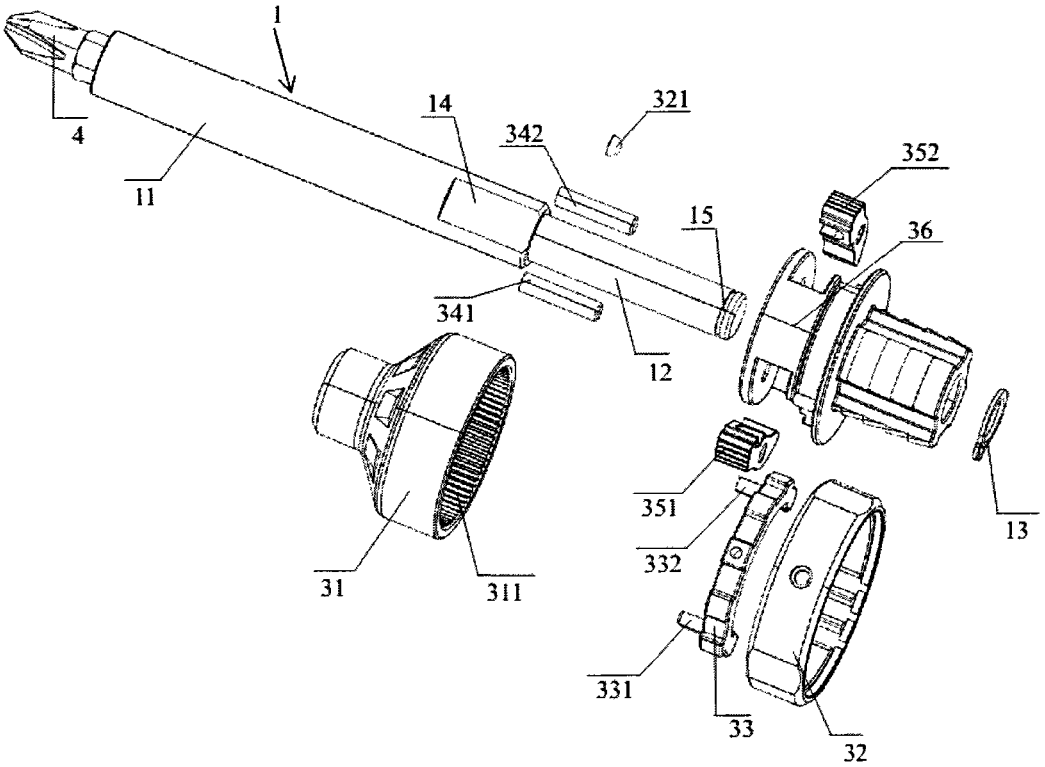
FIG. 6 is an exploded perspective view of FIG. 4 from another angle of view.
Figure 7:
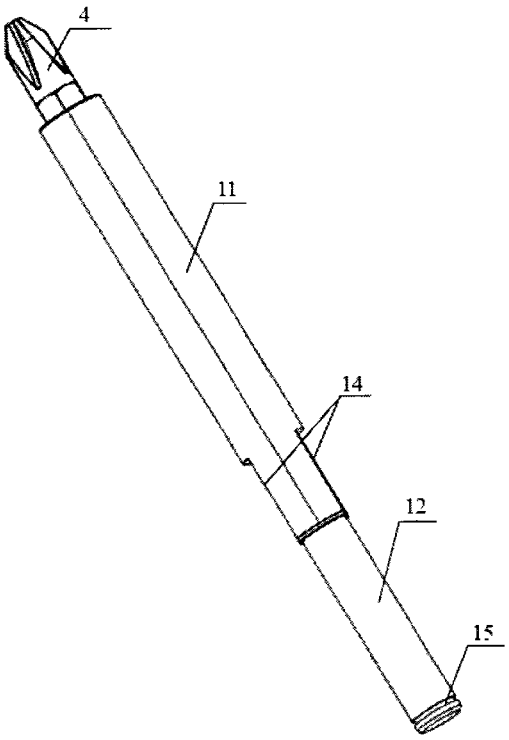
FIG. 7 is a structural schematic view of the shaft member in FIG. 1.
Figure 8:
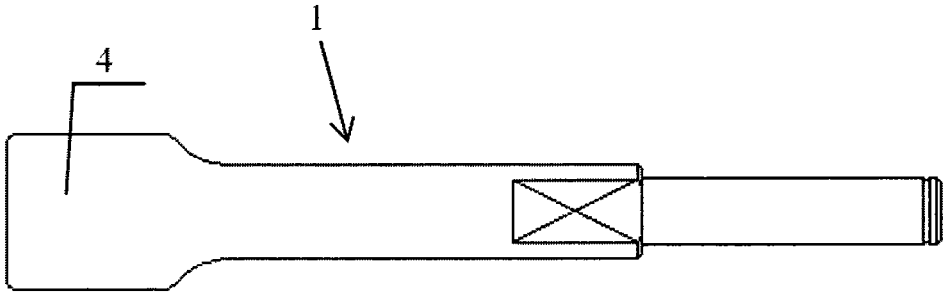
FIG. 8 is a structural schematic view of an operating portion which is a sleeve in FIG. 1.
Figure 9:
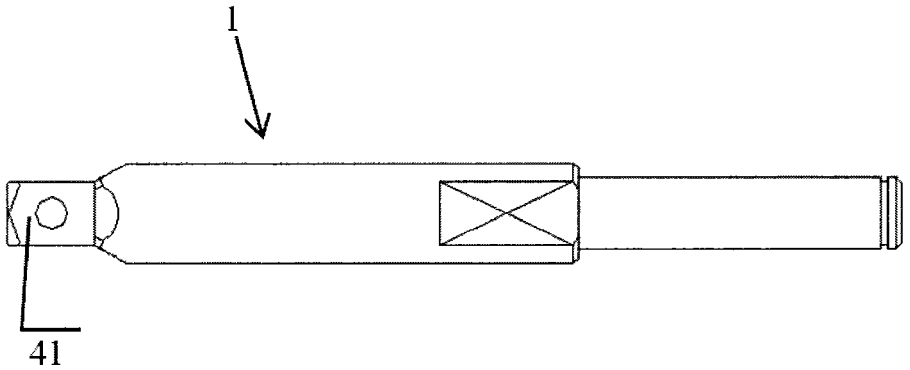
FIG. 9 is another structural schematic view of an operating portion which is a sleeve in FIG. 1.

As shown in FIGS. 4-6, the ratchet mechanism 3 includes a pawl base 36 arranged on the shaft member 1 and passed through by the shaft member 1 along the central axle. The pawl base 36 is symmetrically arranged with two partially rotatable pawls: a first pawl 351 and a second pawl 352 along both sides of the central axle on the pawl base, and a direction switching member 33 for controlling the positional state of the two pawls. The direction switching member 33 has thereon two stopping blocks: a first stopping block 331 and a second stopping block 332. The first stopping block 331 is corresponding to the first pawl 351, and the second stopping block 332 is corresponding to the second pawl 352. A pawl sleeve 31 is arranged outside the first and second pawls 351, 352 and the first and second stopping blocks 331, 332.

Figure 10:
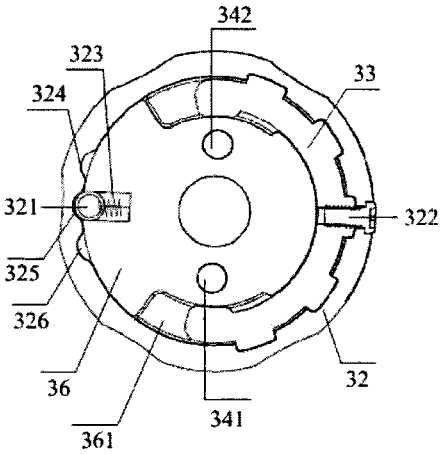
FIG. 10 is a sectional view of the ratchet mechanism taken along B-B in FIG. 4, in which the positioning device is in the middle position.
Figure 11:
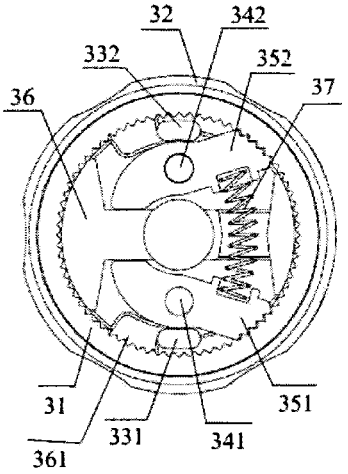
FIG. 11 is a sectional view of the ratchet mechanism taken along C-C in FIG. 4, in which the positioning device is in the middle position.

The inner wall of the pawl sleeve 31 is provided with annularly distributed inner pawl teeth 311, and the pawl sleeve 31 is arranged around the first pawl 351 and the second pawl 352, and the inner pawl teeth 311 thereof engage with the teeth on the first pawl 351 and the second pawl 352. A positioning device 32 connecting the direction switching member 33 is also arranged outside the pawl sleeve 31, and can also be integrally connected to the direction switching member 33. The positioning device 32 is specifically a rotation sleeve, being an annular sleeve arranged around the outside of the pawl sleeve 31. It is shown in FIGS. 10 and 11 when the positioning device 32 is in the middle position.

Figure 12:
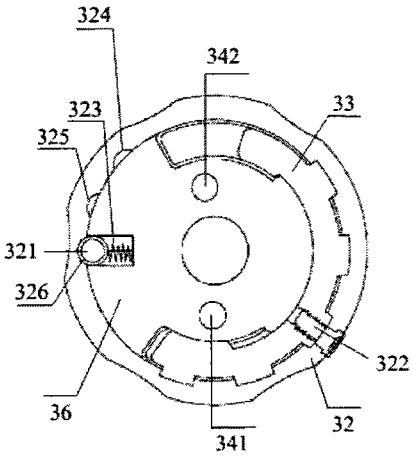
FIG. 12 is a sectional view of the ratchet mechanism taken along B-B in FIG. 4, in which the positioning device is rotated clockwise.
Figure 13:
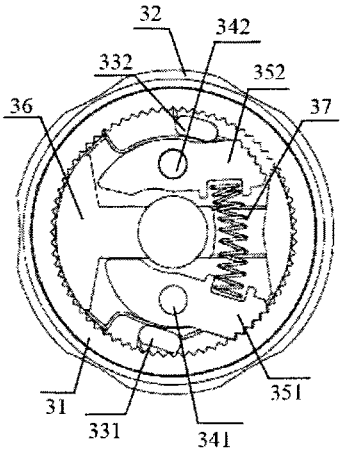
FIG. 13 is a sectional view of the ratchet mechanism taken along C-C in FIG. 4, in which the positioning device is rotated clockwise.
Figure 14:
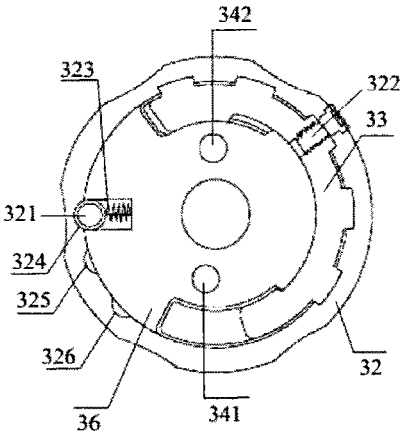
FIG. 14 is a sectional view of the ratchet mechanism taken along B-B in FIG. 4, in which the positioning device is rotated counterclockwise.
Figure 15:
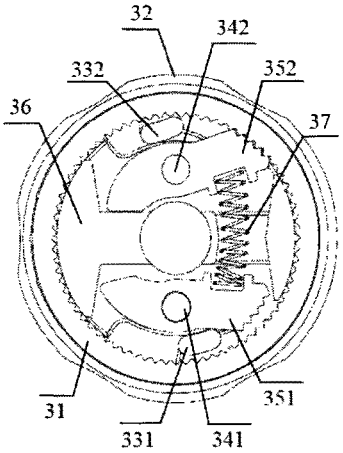
FIG. 15 is a sectional view of the ratchet mechanism taken along C-C in FIG. 4, in which the positioning device is rotated counterclockwise.

When the positioning device 32 is rotated, the direction switching member 33 moves along with it, and the first and second stopping blocks 331, 332 on the direction switching member 33 also move along therewith. As shown in FIGS. 12 and 13, when the positioning device 32 is turned clockwise, the second stopping block 332 presses the second pawl 352 to detach it from the inner pawl teeth 311 of the pawl sleeve 31, and the first pawl 351 continues to engage with the inner pawl teeth 311 of the pawl sleeve 31. At this time, turning the handle clockwise can transfer the torque from the handle to the shaft through the pawl base 36, the first pawl 351 engaging with the pawl sleeve 31 and the pawl sleeve 31. When the handle is turned counterclockwise, the first pawl 351 engaging with the pawl sleeve 31 can be taken by the pawl base 36 to slide over the inner pawl teeth 311 of the pawl sleeve 31 without transferring torque to the shaft, and the handle is turned around. As shown in FIGS. 14 and 15, when the positioning device 32 is rotated counterclockwise, the first stopping block 331 presses the first pawl 351 to detach it from the inner pawl teeth 311 of the pawl sleeve 31, and the second pawl 352 continues to engage with the inner pawl teeth 311 of the pawl sleeve 31. At this time, turning the handle counterclockwise can transfer the torque from the handle to the shaft through the pawl base 36, the second pawl 352 engaging with the pawl sleeve 31 and the pawl sleeve 31. When the handle is turned clockwise the second pawl 352 engaging with the pawl sleeve 31 can be taken by the pawl base to slide over the inner pawl teeth 311 of the pawl sleeve 31 without transferring torque to the shaft, and the handle is turned around. Because no matter which position in the figures the rotation sleeve is rotated to, it can be positioned and maintained in that position.

Further, a first elastic member 37 for making the two pawls 351, 352 open to abut against the pawl sleeve is supported between the first and second pawls. The first stopping block 331 on the direction switching member 33 is positioned outside the corresponding first pawl 351, and the second stopping block 332 on the direction switching member 33 is positioned outside the corresponding second pawl 352, thereby ensuring that the first and second pawls 351, 352 are engaged with the pawl sleeve 31.

In addition, the first pawl 351 is connected to the pawl base 36 through a first pin 341, and the second pawl 352 is connected to the pawl base 36 through a second pin 342, thereby ensuring that the first and second pawls 351,352 can pivot swiftly and that the pawl at the same time has sufficient capacity for transferring torque.

As shown in FIGS. 10-15, the inner wall of the rotation sleeve has a first positioning recess 324, a second positioning recess 325 and a third positioning recess 326, and the pawl base 36 is arranged thereon with a positioning ball 321 which is supported in one of the first positioning recess 324, the second positioning recess 325 and the third positioning recess 326 by a second elastic member 323, so as to realize the positioning of the rotation sleeve on the handle. According to the structure, when the rotation sleeve is in the states as shown in FIGS. 10 and 11, the positioning ball 321 is in the second positioning recess 325, where the first pawl 351, the second pawl 352 are in the state as shown in FIG. 11. When the rotation sleeve is in the states as shown in FIGS. 12 and 13, the positioning ball 321 is in the third positioning recess 326, where the first pawl 351, the second pawl 352 are in the state as shown in FIG. 13. When the rotation sleeve is in the states as shown in FIGS. 14 and 15, the positioning ball 321 is in the first positioning recess 324, where the first pawl 351, the second pawl 352 are in the state as shown in FIG. 15.

As shown in FIGS. 10 and 11, the pawl base has a recess 361, in which the direction switching member 33 is located, and the rotation sleeve and the direction switching member 33 are connected through a fastener 322 (such as a screw) therebetween, thereby realizing constraining the rotation sleeve by limiting the direction switching member 33 in the recess 361 unable to move axially, that is, forbidding the rotation sleeve to detach from the working position through a fastener 322, while realizing actuating the direction switching member 33 by the rotation sleeve.

In order to further diminish the turning force required when turning back to optimize the 'directional' feature, the present invention further improves the number of teeth of the inner pawl teeth 311 of the pawl sleeve 31. In this embodiment, the number of the teeth of the inner pawl teeth 311 is greater than 60, preferably equal to or greater than 72 (for example, 72).

Meanwhile, in order to strengthen the capacity of transferring torque, the present invention increases the number of teeth of the first and second pawls engaging with the pawl sleeve 31. In this embodiment, the number of teeth of the first and second pawls is set to be greater than 3, preferably equal to or greater than 5 (for example, 5). Correspondingly, the number of teeth of the inner pawl teeth 311 of the pawl sleeve 31, under the premise of the number being greater than 60, is set to match with the number of teeth of the first and second pawls.

Embodiment Two

This embodiment is similar to Embodiment One, the main difference of which is the structure of the shaft member.

In this embodiment, the shaft member has a first end away from the handle and a second end adjacent the handle, and a middle portion located between the first end and the second end. The radius of the middle portion is greater than that of the portion extending to both sides from the middle portion. When the first end of the shaft member extends into the interior of the ratchet mechanism, the pawl sleeve is put on, and as the radius of the middle portion is greater, so that axially securing of the shaft member can be realized. Alternatively, when the shaft member is pull out, the second end of the shaft member is inserted into the interior of the ratchet mechanism, the pawl sleeve is put on, and axially securing of the shaft member can also be realized.

In which, the first end of the shaft member may specifically be an operating portion, such as a sleeve, a connecting member mounted with sleeve, a screwdriver bit of various models (such as a hex socket, cross screwdriver bit, etc.) etc., and the second end of the shaft member may specifically be an operating portion as well, such as a sleeve, a connecting member mounted with sleeve, a screwdriver bit of various models (such as a hex socket, cross screwdriver bit, etc.) etc., in which, preferably, the feature of the first end and that of the second end that are realized are not the same, that is, the first end and the second end of the shaft member have two different features. When the first end of the shaft member is located inside the ratchet mechanism, the ratchet tool has one feature; and when the shaft member is pulled out and used with the direction switched, that is, when the second end of the shaft member is inside the ratchet mechanism, the ratchet tool has another feature. Such design of the shaft member realizes the free dismounting and the use in both directions of the shaft member, and further enables two different features in one ratchet tool the ratchet tool to have two different features.

Embodiment Three

FIG. 1, FIG. 4 and FIGS. 10-21 illustrate the structural schematic views of another preferred embodiment of the present invention.

This embodiment is similar to Embodiment One, the main difference of which is the structure of the shaft member 1.

Figure 16:
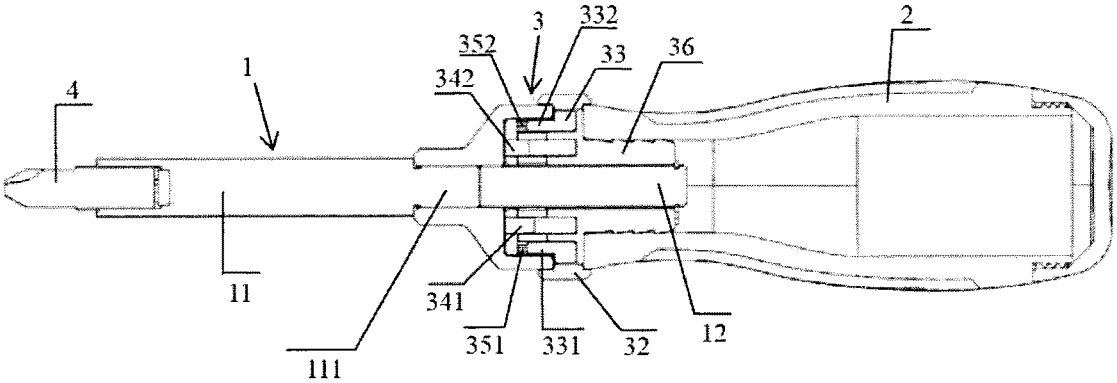
FIG. 16 is a sectional view of another preferred embodiment of the ratchet tool of the present invention.
Figure 17:
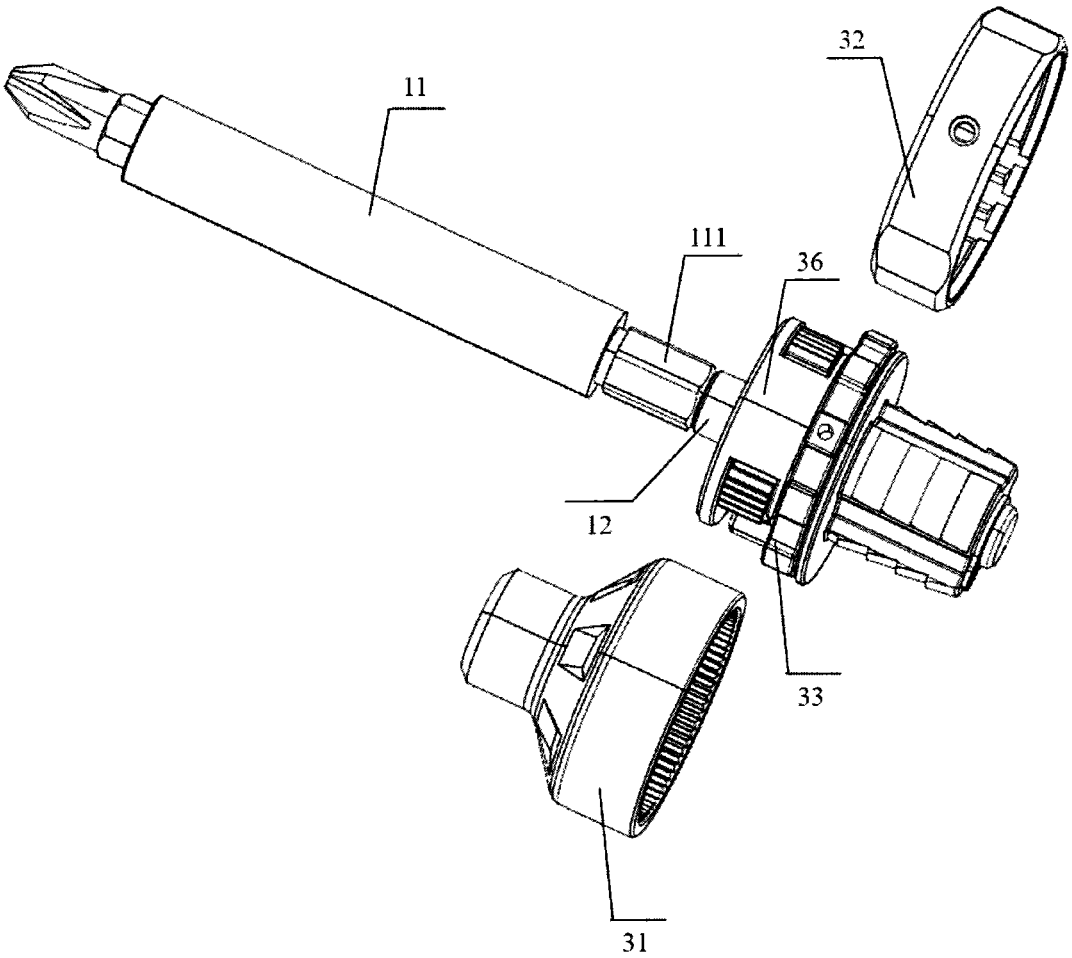
FIG. 17 is an exploded perspective view of the direction switching mechanism, shaft member and ratchet mechanism of the ratchet tool in FIG. 16 from an angle of view.

As shown in FIG. 16, the ratchet tool of the present invention includes a shaft member 1, a handle 2 and a ratchet mechanism 3. The handle 2 is connected to the ratchet mechanism 3, and the shaft member 1 extends into the interior of the ratchet mechanism 3 along the central axle of the ratchet mechanism 3 from the front end of the ratchet mechanism 3 and is connected to the ratchet mechanism 3. In this embodiment, the shaft member 1 preferably passes through the rear end of the ratchet mechanism 3 along the central axle of the ratchet mechanism 3 from the front end of the ratchet mechanism 3 and is connected to the ratchet mechanism 3.

In which, the shaft member 1 further includes a shaft 11 and an extension portion 12. In this embodiment, the shaft 11 is designed to be separated from the extension portion 12 which extends into the interior of the ratchet mechanism 3 and passes through the rear end of the ratchet mechanism 3 along the central axle of the ratchet mechanism 3 from the front end of the ratchet mechanism 3 and is connected to the ratchet mechanism 3. The structure of the shaft member 1 is more clearly illustrated in FIGS. 18-19, where the shaft 11 is provided with a hexagonal axle end 111 which matches with the pawl sleeve 31. The hexagonal axle end 111 passes through the pawl sleeve 31, used for firmly securing the shaft 11 and the pawl sleeve 31, to make the shaft 11 not wobble relative to the pawl sleeve 31 when torque is being transferred.

An operating portion 4 is provided on the end of the shaft member 1 away from the handle for outputting torque. The operating portion 4 may specifically be a screwdriver bit of various models, such as a slotted, torx or hex socket screwdriver bit, which is mounted on the end of the shaft member 1 away from the handle (shown in FIG. 16). The operating portion 4 may also be a sleeve of various models, and the sleeve may be designed to be integrated with the shaft member 1 (shown in FIG. 20), and may be connected to the shaft member 1 through a connecting member 41 (shown in FIG. 21) which can be used for mounting sleeves of various models.

The rear end of the extension portion 12 is provided with an axle slot 15, and a fastening ring 13 (such as a retainer ring) is correspondingly designed for matching the axle slot 15. When the extension portion 12 passes through the bore of the pawl base 36, the extension portion 12 contacts the hexagonal axle end 111 closely, and the fastening ring 13 matching the axle slot 15 is stuck into the axle slot 15. As the hexagonal axle end 111 and the pawl sleeve 31 cooperate with each other, and the axle slot 15 and the fastening ring 13 are cooperatively used in combination, the pawl base 36 is firmly secured to the shaft member without axial movement. In addition, the shaft-through connecting of the shaft member 1 and the ratchet mechanism 3 provides a long matching surface between the shaft member 1 and the bore of the pawl base 36, increasing the contact area between the shaft member 1 and the pawl base 36, so that the wobble problem of the shaft 11 relative to the pawl base 36 when using the ratchet tool is solved, and the screwing efficiency is good.

In this embodiment, the inputted torque from the handle 2 in either direction (clockwise or counterclockwise) is transferred to the shaft member 1, making it output the torque in a predetermined direction (either clockwise or counterclockwise).

Figure 18:
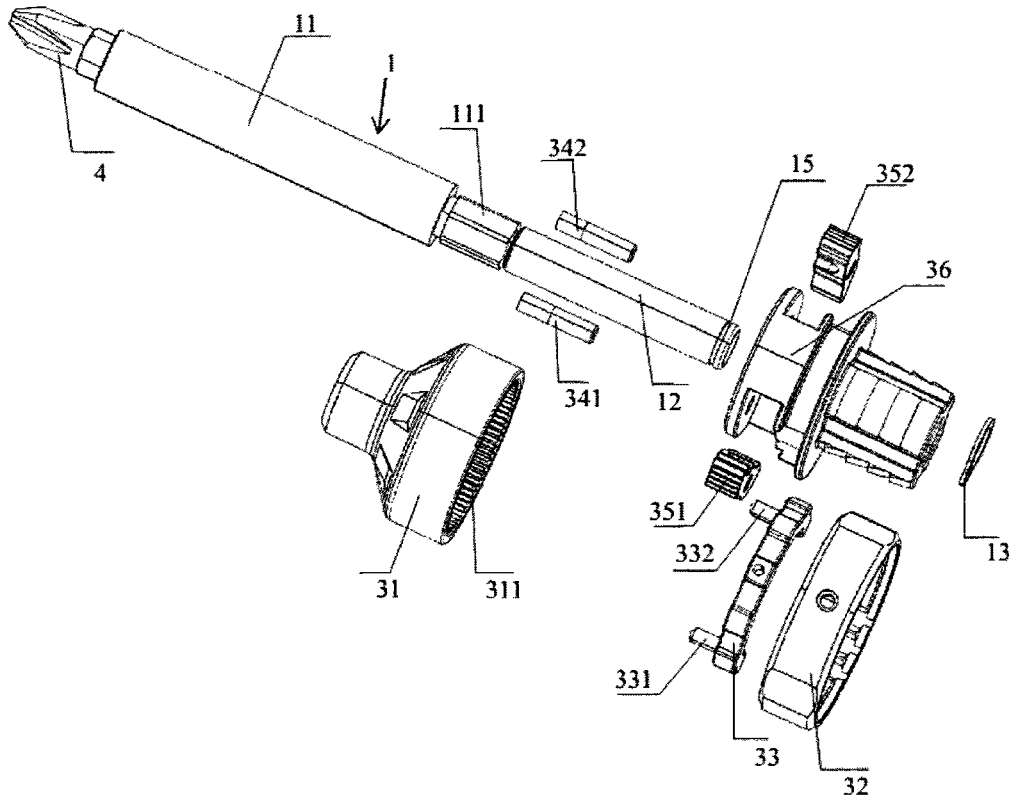
FIG. 18 is an exploded perspective view of the direction switching mechanism, shaft member and ratchet mechanism of the ratchet tool in FIG. 16 from another angle of view.
Figure 19:
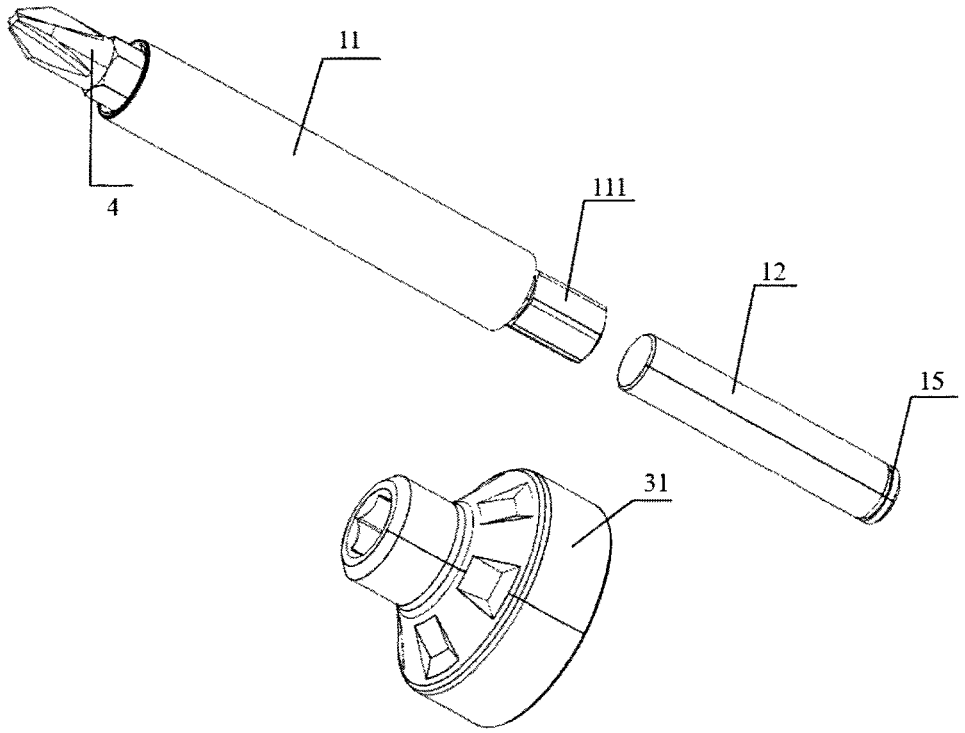
FIG. 19 is an exploded perspective view of the shaft member and pawl sleeve in FIG. 18 from an angle of view.
Figure 20:
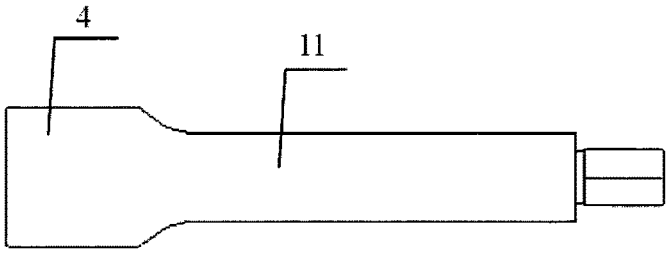
FIG. 20 is a structural schematic view of the operating portion which is a sleeve in FIG. 16.
Figure 21:
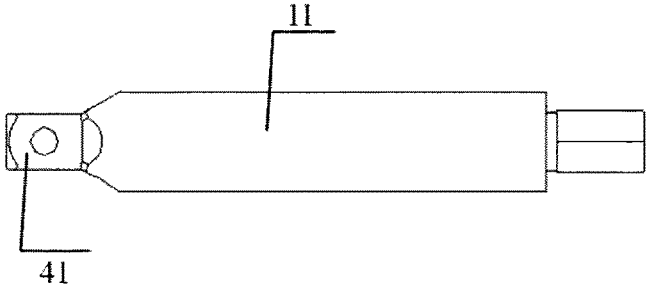
FIG. 21 is another structural schematic view of the operating portion which is a sleeve in FIG. 16.
Figure 22:
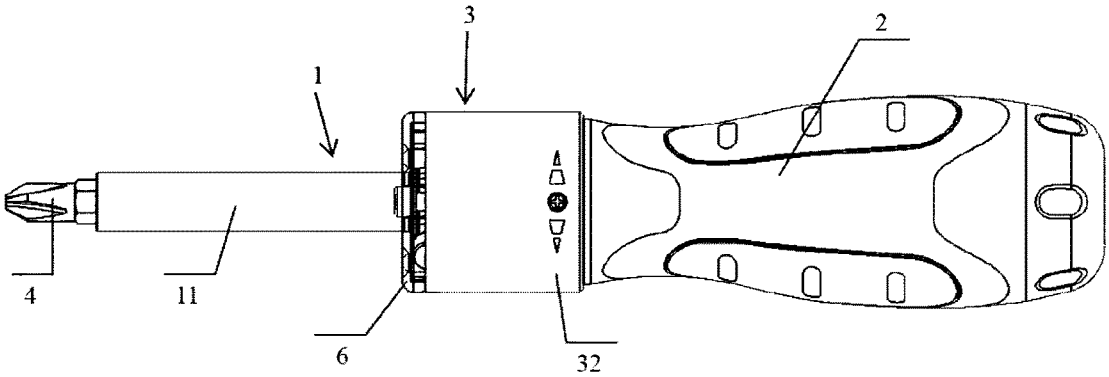
FIG. 22 is a main view of another preferred embodiment of the ratchet tool of the present invention.

As shown in FIG. 4 and FIG. 18, the ratchet mechanism 3 includes a pawl base 36 arranged on the shaft member 1 and passed through by the shaft member 1 along the central axle. The pawl base 36 is symmetrically arranged with two partially rotatable pawls: a first pawl 351 and a second pawl 352 along both sides of the central axle on the pawl base 36, and a direction switching member 33 for controlling the positional state of the two pawls, the direction switching member 33 having thereon two stopping blocks: a first stopping block 331 and a second stopping block 332. The first stopping block 331 is corresponding to the first pawl 351, and the second stopping block 332 is corresponding to the second pawl 352. A pawl sleeve 31 is arranged outside the first and second pawls 351, 352 and the first and second stopping blocks 331, 332.

The inner wall of the pawl sleeve 31 is provides with annularly distributed inner pawl teeth 311, and the pawl sleeve 31 is arranged around the first pawl 351, the second pawl 352, and the inner pawl teeth 311 thereof engage with the teeth on the first pawl 351, the second pawl 352. A positioning device 32 connecting the direction switching member 33 is also arranged outside the pawl sleeve 31, and can also be integrally connected to the direction switching member 33. The positioning device 32 is specifically a rotation sleeve, being an annular sleeve arranged around the outside of the pawl sleeve 31. It is shown as in FIGS. 10 and 11 when the positioning device 32 is in the middle position.

When the positioning device 32 is rotated, the direction switching member 33 moves along with it, and the first and second stopping blocks 331, 332 on the direction switching member 33 also move along therewith. As shown in FIGS. 12 and 13, when the positioning device 32 is turned clockwise, the second stopping block 332 presses the second pawl 352 to detach it from the inner pawl teeth 311 of the pawl sleeve 31, and the first pawl 351 continues to engage with the inner pawl teeth 311 of the pawl sleeve 31. At this time, turning the handle clockwise can transfer the torque from the handle to the shaft through the pawl base 36, the first pawl 351 engaging with the pawl sleeve 31 and the pawl sleeve 31. When the handle is turned counterclockwise the first pawl 351 engaging with the pawl sleeve 31 can be taken by the pawl base 36 to slide over the inner pawl teeth 311 of the pawl sleeve 31 without transferring torque to the shaft, and the handle is turned around. As shown in FIGS. 14 and 15, when the positioning device 32 is rotated counterclockwise, the first stopping block 331 presses the first pawl 351 to detach it from the inner pawl teeth 311 of the pawl sleeve 31, and the second pawl 352 continues to engage with the inner pawl teeth 311 of the pawl sleeve 31. At this time, turning the handle counterclockwise can transfer the torque from the handle to the shaft through the pawl base 36, the second pawl 352 engaging with the pawl sleeve 31 and the pawl sleeve 31. When the handle is turned clockwise the second pawl 352 engaging with the pawl sleeve 31 can be taken by the pawl base to slide over the inner pawl teeth 311 of the pawl sleeve 31 without transferring torque to the shaft, and the handle is turned around. No matter which position in the figure the rotation sleeve is rotated to, it can be positioned and maintained in that position.

Further, a first elastic member 37 for making the two pawls 351, 352 open to abut against the pawl sleeve is supported between the first and second pawls. The first stopping block 331 on the direction switching member 33 is positioned outside the corresponding first pawl 351, and the second stopping block 332 on the direction switching member 33 is positioned outside the corresponding second pawl 352, thereby ensuring that the first and second pawls 351, 352 are engaged with the pawl sleeve 31.

In addition, the first pawl 351 is connected to the pawl base 36 through a first pin 341, and the second pawl 352 is connected to the pawl base 36 through a second pin 342, thereby ensuring that the first and second pawls 351,352 can pivot swiftly and that the pawl possesses sufficient capacity for transferring torque as well in the same time.

As shown in FIGS. 10-15, the inner wall of the rotation sleeve is provides with a first positioning recess 324, a second positioning recess 325 and a third positioning recess 326, and the pawl base 36 is arranged thereon with a positioning ball 321 which is supported in one of the first positioning recess 324, the second positioning recess 325 and the third positioning recess 326 by a second elastic member 323, so as to realize the positioning of the rotation sleeve on the handle. According to the structure, when the rotation sleeve is in the states as shown in FIGS. 10 and 11, the positioning ball 321 is in the second positioning recess 325, where the first pawl 351, the second pawl 352 are in the state as shown in FIG. 11. When the rotation sleeve is in the states as shown in FIGS. 12 and 13, the positioning ball 321 is in the third positioning recess 326, where the first pawl 351, the second pawl 352 are in the state as shown in FIG. 13. When the rotation sleeve is in the states as shown in FIGS. 14 and 15, the positioning ball 321 is in the first positioning recess 324, where the first pawl 351, the second pawl 352 are in the state as shown in FIG. 15.

As shown in FIGS. 10 and 11, the pawl base is provides with a recess 361, in which the direction switching member 33 is located, and the rotation sleeve and the direction switching member 33 are connected through a fastener 322 (such as a screw) therebetween, thereby realizing constraining of the rotation sleeve by limiting the direction switching member 33 in the recess 361 unable to move axially, that is, forbidding the rotation sleeve to detach from the working position through a fastener 322, while realizing actuating the direction switching member 33 by the rotation sleeve.

In order to further diminish the turning force required when turning back to optimize the 'directional' feature, the present invention further improves the number of teeth of the inner pawl teeth 311 of the pawl sleeve. In this embodiment, the number of the teeth of the inner pawl teeth 311 is greater than 60, preferably equal to or greater than 72 (for example, 72).

Meanwhile, in order to strengthen the capacity of transferring torque, the present invention increases the number of teeth of the first and second pawls engaging with the pawl sleeve 31. In this embodiment, the number of teeth of the first and second pawls is set to be greater than 3, preferably equal to or greater than 5 (for example, 5). Correspondingly, the number of teeth of the inner pawl teeth 311 of the pawl sleeve 31, under the premise of being greater than 60, is set to match with the number of teeth of the first and second pawls.

Embodiment Four

FIG. 7, FIGS. 10-15 and FIGS. 22-25 illustrate structural schematic views of a further preferred embodiment of the present invention.

It can be seen from the figures that this embodiment is similar to Embodiment One, the main difference of which is an added lighting device.

Figure 23:
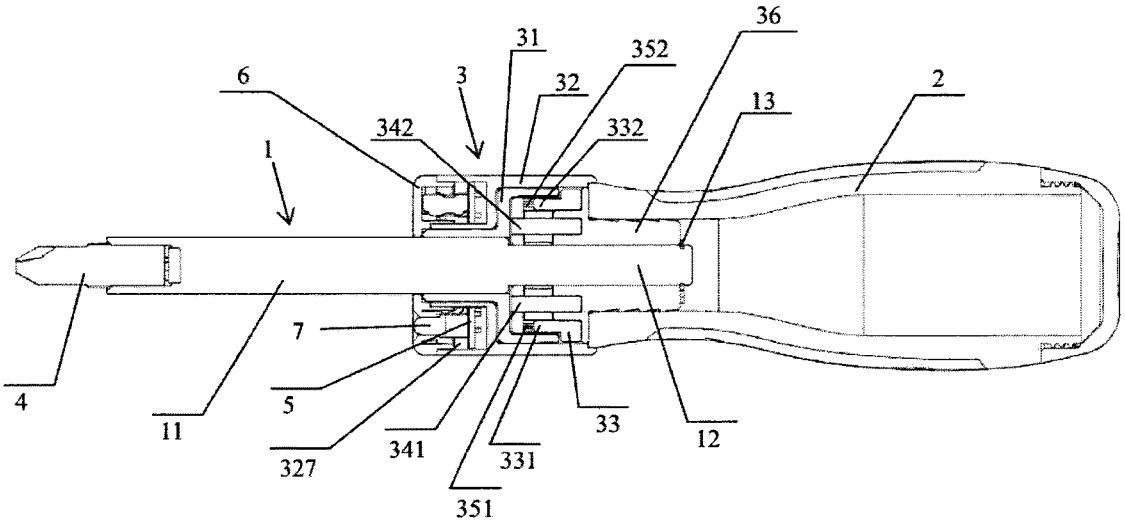
FIG. 23 is a longitudinal sectional view of the ratchet tool in FIG. 22, in which the shaft member passes through the pawl base.
Figure 24:
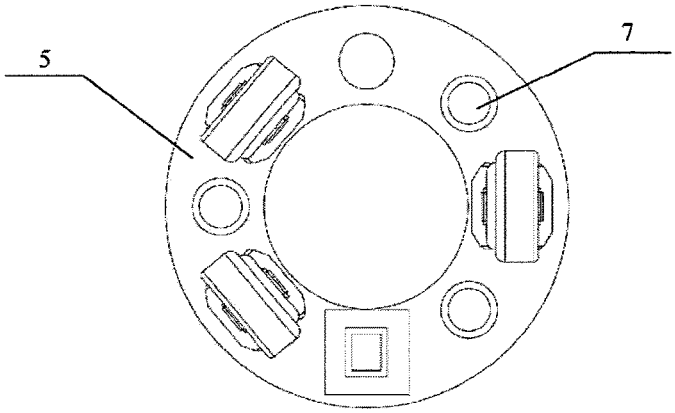
FIG. 24 is a schematic view of the lighting device in FIG. 23 from an angle of view.
Figure 25:
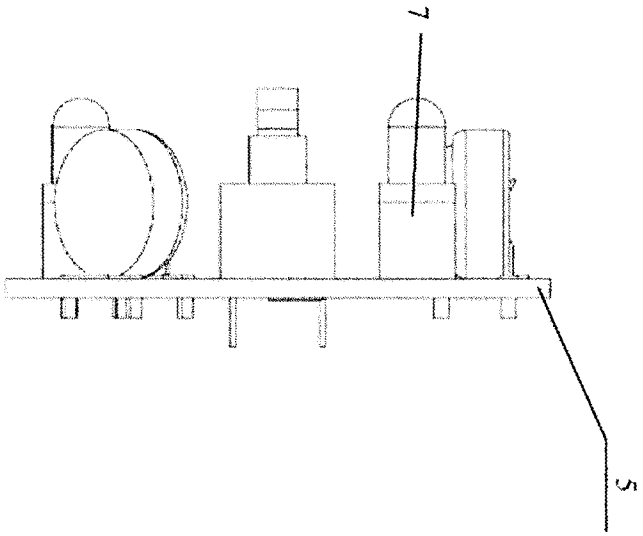
FIG. 25 is a schematic view of the lighting device in FIG. 23 from another angle of view.

This embodiment added a lighting device on the basis of Embodiment One. The specific location of the lighting device is shown in FIG. 23. The positioning device 32 is specifically a rotation sleeve, being an annular sleeve arranged around the outside of the pawl sleeve 31. In this embodiment, the positioning device 32 has a cavity 321, where the light device is mounted. As shown in FIGS. 24 and 25, the lighting device includes an electric circuit board 5 and a power 7 mounted on the electric circuit board. When the lighting device is securely mounted in the cavity 321 of the positioning device 32, a transparent cover 6 covers up and is secured to the positioning device 32, which realizes the lighting feature.

The application of lighting device in this embodiment realizes an efficient combination of ratchet rotation component and lighting device, which enables the ratchet tool of the present invention to not only have the feature of rotation component, but also have the feature of lighting at the same time.

Embodiment Five

This embodiment is similar to Embodiment Two and Three, the main difference of which is an added lighting device. The lighting device is the same as the lighting device in Embodiment Four.

The invention has been exemplified above with reference to specific embodiments.

However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A ratchet tool, comprising a shaft member, a handle and a ratchet mechanism, wherein the handle is connected to the ratchet mechanism, and the shaft member extends into the interior of the ratchet mechanism along the central axle of the ratchet mechanism from the front end of the ratchet mechanism and is connected to the ratchet mechanism; the shaft member includes a shaft and an extension portion, and the shaft is designed to be integrated with the extension portion.

2. The ratchet tool according to claim 1, wherein the shaft member passes through the rear end of the ratchet mechanism along the central axle of the ratchet mechanism from the front end of the ratchet mechanism and is connected to the ratchet mechanism.

3. The ratchet tool according to claim 1, wherein the shaft member is connected to the ratchet mechanism in a removable way.

4. The ratchet tool according to claim 3, wherein the shaft member has a first end away from the handle and a second end adjacent the handle, the first end or the second end is able to extend into the interior of the ratchet mechanism along the central axle of the ratchet mechanism from the front end of the ratchet mechanism and is connected to the ratchet mechanism.

5. The ratchet tool according to claim 1, wherein the extension portion extends into the interior of the ratchet mechanism and passes through the rear end of the ratchet mechanism along the central axle of the ratchet mechanism from the front end of the ratchet mechanism and is connected to the ratchet mechanism.

6. The ratchet tool according to claim 5, wherein the shaft is designed to be separated from the extension portion.

7. The ratchet tool according to claim 5, wherein the ratchet mechanism includes a pawl base symmetrically arranged with two partially rotatable pawls: a first pawl and a second pawl, along both sides of the central axle on the pawl base, and a direction switching member for controlling the positional state of the two pawls, the direction switching member has thereon two stopping blocks: a first stopping block and a second stopping block at the outside of the two pawls respectively for pushing the first pawl and the second pawl respectively, a pawl sleeve is arranged outside the first and second pawls and the first and second stopping blocks, the inner wall of the pawl sleeve has annularly distributed inner pawl teeth, and the pawl sleeve engages with the teeth on the first pawl and the second pawl.

8. The ratchet tool according to claim 7, wherein the end of the shaft adjacent the handle is provided with a key slot matching the pawl sleeve and used for securing the shaft and the pawl sleeve.

9. The ratchet tool according to claim 7, wherein the end of the shaft adjacent the handle is provided with an axle end, which matches the pawl sleeve and is used for securing the shaft and the pawl sleeve.

10. The ratchet tool according to claim 9, wherein the axle end is a hexagonal axle end.

11. The ratchet tool according to claim 7, wherein the number of the inner pawl teeth of the pawl sleeve is larger than 60.

12. The ratchet tool according to claim 11, wherein the number of the inner pawl teeth of the pawl sleeve is 72.

13. The ratchet tool according to claim 7, wherein the number of the teeth of the first pawl is larger than 3, and the number of the teeth of the second pawl is larger than 3.

14. The ratchet tool according to claim 13, wherein the number of the teeth of the first pawl is 5, and the number of the teeth of the second pawl is 5.

15. The ratchet tool according to claim 7, wherein a positioning device connecting the direction switching member is also arranged outside the pawl sleeve.

16. The ratchet tool according to claim 15, wherein the positioning device is an annular sleeve arranged around the outside of the pawl sleeve.

17. The ratchet tool according to claim 15, wherein the ratchet tool further includes a lighting device, the positioning device including a cavity where the light device is mounted.

18. The ratchet tool according to claim 17, wherein the lighting device includes an electric circuit board and a power mounted on the electric circuit board.

19. The ratchet tool according to claim 5, wherein the extension portion is provided with an axle slot, which matches a fastening ring and makes the extension portion not movable relative to the ratchet mechanism in axial direction.

* * * * *